US005909177A

United States Patent [19]

Rührig

[11] Patent Number: 5,909,177

[45] Date of Patent: Jun. 1, 1999

[54] SECURITY ELEMENT FOR ELECTRONIC ARTICLE SURVEILLANCE AND METHOD OF MANUFACTURING A SECURITY ELEMENT

[75] Inventor: Manfred Rührig, Weinheim, Germany

[73] Assignee: Esselte Meto International GmbH, Heppenheim, Germany

[21] Appl. No.: 08/940,026

[22] Filed: Sep. 29, 1997

[30] Foreign Application Priority Data

Oct. 12, 1996 [DE] Germany ..... 196 42 225

[51] Int. Cl.[6] ..... G08B 13/14

[52] U.S. Cl. ..... 340/572.1; 340/572.3; 340/572.6

[58] Field of Search ..... 340/572, 551; 428/457, 900, 611, 621

[56] References Cited

U.S. PATENT DOCUMENTS

| | | | |
|---|---|---|---|
| 4,568,921 | 2/1986 | Pokalsky | 340/551 |
| 4,882,569 | 11/1989 | Dey . | |
| 4,935,724 | 6/1990 | Smith | 340/551 |
| 4,956,636 | 9/1990 | Sansom et al. | 340/551 |
| 4,960,651 | 10/1990 | Pettigrew et al. | 340/551 |
| 4,967,185 | 10/1990 | Montean | 340/551 |
| 5,017,907 | 5/1991 | Cordery et al. . | |
| 5,355,120 | 10/1994 | Ferguson et al. . | |
| 5,368,948 | 11/1994 | Davies | 340/551 |
| 5,399,372 | 3/1995 | Grimes et al. | 340/551 |
| 5,432,499 | 7/1995 | Montean | 340/551 |
| 5,477,219 | 12/1995 | Zarembo et al. | 340/551 |
| 5,495,230 | 2/1996 | Lian | 340/551 |

FOREIGN PATENT DOCUMENTS

| | | |
|---|---|---|
| 0093281 | 11/1983 | European Pat. Off. . |
| 0260831 | 3/1988 | European Pat. Off. . |
| 0629982 | 12/1994 | European Pat. Off. . |
| 0690425 | 1/1996 | European Pat. Off. . |
| 0696784 | 2/1996 | European Pat. Off. . |

*Primary Examiner*—Nina Tong
*Attorney, Agent, or Firm*—Jones, Tullar & Cooper, P.C.

[57] ABSTRACT

The present invention is directed to a security element for electronic article surveillance in an electromagnetic surveillance system, comprising a soft magnetic, magnetostrictive strip and a premagnetization element fabricated from a semi-hard or hard magnetic material that is associated with the strip, and to a method of manufacturing such security elements.

With regard to the security element the premagnetization element is configured such that, by application of an essentially constant external field (H), it produces a stray field that optimizes the magneto-elastic properties of the stripe.

18 Claims, 5 Drawing Sheets

SECURITY ELEMENT FOR ELECTRONIC ARTICLE SURVEILLANCE AND METHOD OF MANUFACTURING A SECURITY ELEMENT

BACKGROUND OF THE INVENTION

1. Technical Field

This invention relates to a security element for electronic article surveillance in an electromagnetic surveillance system, comprising a soft magnetic, magnetostrictive strip and a premagnetization element fabricated from a semi-hard or hard magnetic material (for example, SEMIVAC by the firm Vacuumschmelze) that is associated with the strip, and to a method of manufacturing such a security element.

2. Background Art

From EP 0 093 281 B1, a security element and a surveillance apparatus for a corresponding security element attached to the article subject to surveillance are already known. The security element is comprised of an elongated strip of a preferably amorphous magnetic material of high permeability and magnetostriction. The strip is designed to be incited to mechanical vibrations at the frequency of the incident alternating magnetic field of the surveillance apparatus. The elastic postoscillatory response and the change in the magnetization of the strip coupled thereto on account of the magnetostrictive phenomenon induce a voltage change in the receiver device.

By suitable alloy compositions it is possible to vary the strip's magnetostrictive properties in wide ranges. A feature common to all these alloys is that a more or less distinct preferred direction transverse to the strip's longitudinal axis can be impressed upon them by an appropriate heat treatment.

This transversal anisotropy is necessary to incite mechanical vibrations in the material with fields along the longitudinal axis of the strip. Because the length variation is a square function of the cosine of the change in the magnetization, the maximum length variation and thus the maximum magneto-elastic effect are obtained when the direction of the magnetization is adjusted to an approximately 45° angle to the strip's longitudinal axis. This is accomplished by suitably premagnetizing the strip in an external field of sufficient intensity. In the absence of demagnetizing effects, an amount 0.7 times the intensity of the anisotropic field of the induced anisotropy would be required. Generally, however, lower field strengths are sufficient.

The intensity of premagnetization thus determines both the amplitude of the oscillation and the natural resonant frequency of the strip. Proper adjustment of the premagnetization is the absolute prerequisite for the obtainment of an optimum resonant response of the strip at the emitted interrogation frequency of the transmitter device. The term optimum as used herein means that the characteristic signal has a sufficiently high oscillation amplitude, in addition to dying out optimally.

For technical implementation of the premagnetization, it is proposed in EP 0 093 281 B1 to produce a stray field of sufficient intensity along the strip by means of one or several magnetic elements which are magnetized and arranged in close proximity to the strip. Deactivation of the security element is then accomplished simply by demagnetizing the security element or magnetizing the premagnetization element in antiparallel areas, causing the stray field to disappear. However, this method is not absolutely reliable. As a result of the still relatively high permeability of the not premagnetized strip, an alarm may be produced although deactivation has taken place in surveillance apparatus operating on the basis of a harmonic principle (=detection of harmonic waves), in particular where the hysteresis curve of the strip proceeds along a non-linear course.

In addition, the inhomogeneities in both the strip and the premagnetization elements may cause relatively severe fluctuations in the magneto-elastic properties, particularly the resonant frequency. As a result of the spread of the magnetic parameters (resonant frequency, decay) thereby produced, the risk then exists that the security element fails to be reliably detected by the surveillance apparatus.

To reduce the material-induced spread of the resonance properties, it is proposed in EP 0 690 425 A1 to cut the strip to the appropriate length during manufacture. This is a relatively complicated approach involving high manufacturing cost.

EP 0 696 784 A1 proposes circumventing this problem. As in EP 0 093 281 B1, a premagnetization element is used whose stray field is dimensioned such as to enable the magneto-elastic strip to be magnetized to a higher degree. For one purpose, this makes it possible to deactivate the security element such as to prevent it from being detected also in other surveillance systems; for another purpose, the resonant frequency can be tuned to the respective frequency of the interrogation field within specified limits by selected magnetization of the premagnetization element, thereby enabling inhomogeneities in the materials employed to be compensated for.

The disadvantage of this method is that for the purpose of optimizing the strip's magneto-elastic response it is necessary to adjust the magnetization of the premagnetization element individually by suitable selection of an external field.

SUMMARY OF THE INVENTION

It is an object of the present invention to provide a security element and a method of manufacturing such a security element which afford economy of manufacture of the security elements.

With regard to the security element according to the present invention, this object is accomplished in that the premagnetization element is configured such that, by application of an essentially constant external field, it produces a stray field that optimizes the magneto-elastic properties of the strip.

The security element of the present invention is eminently advantageous. Thus, on completion of deactivation (=no characteristic resonant response in the interrogation field), the security element can be reactivated with substantially greater ease because the necessary external field is approximately identical for all security elements of the present invention. This is particularly advantageous when it is desired to reactivate several security elements at a time, as is frequently the case where articles are protected at the source, for example. Source protection means that the security elements are already integrated into the merchandise or their packaging at the manufacturing stage. As a rule, source protection utilizes deactivated security elements, because it is undesirable to spread active security elements unnecessarily. Activation takes place at the site within the zone subject to surveillance. In this case it is, of course, extremely desirable to have security elements that are all activatable by means of the same magnetic field.

In an advantageous further aspect of the security element of the present invention, the strip and the premagnetization element are spaced from each other by a distance d.

Moreover, it has proven to be advantageous to provide the strip with an essentially linear magnetization curve. This provides the possibility of deactivating the security element by demagnetization of the premagnetization element, without involving the risk of false alarms being produced in surveillance systems operating on the basis of the harmonic principle. In particular in this event provision is made for configuring the premagnetization element such as to be driven into saturation by the external field, its remnant magnetization upon saturation then producing the desired stray field without external field.

An advantageous further aspect of the security element of the present invention makes provision for the premagnetization element to be configured such that the stray field produced by the premagnetization element is smaller than the field necessary to achieve saturation of the strip. This configuration has the advantage of enabling later deactivation in a simple and reliable manner for all surveillance systems by complete magnetization.

In another advantageous configuration, the premagnetization element is subdivided into areas of opposite magnetization which premagnetize the strip such as to deactivate it.

In an advantageous configuration of the security element of the present invention, it is proposed provide the premagnetization element with areas devoid of material. A first feature thus makes provision for the premagnetization element to have air gaps of a width a arranged at a relative distance b, or for holes of a radius r in the premagnetization element which are spaced from each other by a distance s.

An alternative embodiment proposes heat-treating the premagnetization element in selected areas of a width a, with the areas being arranged at a relative distance b. The effect is comparable to the effect obtained by reducing the material: The magnetization component in the selected areas is significantly smaller than in the surrounding areas of the premagnetization element. For heat treatment conventional processes may be employed such as the supply of current or the supply of energy by means of a laser beam, or by means of induction.

Clearly, the advantage of heat treatment over the reduction of material lies in the greater ease of manufacture of the security elements. As heretofore, the security element involves a coherent part lending itself to ready integration into conventional manufacturing processes. In addition, both the width and the relative distance of the selected areas can be varied deliberately, thus enabling the stray field produced and the attendant oscillatory response of the strip to be varied continuously within wide ranges.

According to an advantageous further aspect of the security element of the present invention, it is proposed apply mechanical stress or a magnetic field to the selected areas to adjust a magnetic preferred direction transverse to the longitudinal direction of the premagnetization element.

Still further, it is advantageous to heat-treat the premagnetization element in an oxidizing atmosphere.

According to a last further aspect of the security element of the present invention, the width a of the selected areas is small compared to the relative distance d of the strip to the premagnetization element.

With regard to the method of manufacturing the security element according to the present invention, the object is accomplished in that the premagnetization element is magnetized to saturation by a substantially constant external field; after the external field is removed, the oscillatory response of the strip is checked; the physical properties of the premagnetization element are changed if the oscillatory response of the security element is not consistent with a predetermined value.

According to an advantageous further aspect of the method of the present invention, provision is made for changing the physical properties of the premagnetization element such that following deactivation of the external field the security element has a higher or a lower remnant magnetization than prior to the change.

Particularly suitably, the method is integrated into a learning system. In a learning system, the individual process steps are executed continuously on successive security elements until the desired oscillatory response is obtained. This "learning system" enables even minor changes in the predetermined values to be compensated for promptly, so that all security elements exhibit the same oscillatory response.

The present invention will be described in more detail in the following with reference to the accompanying drawings. In the drawings,

DESCRIPTION OF THE PREFERRED EMBODIMENTS

Figure 1A:
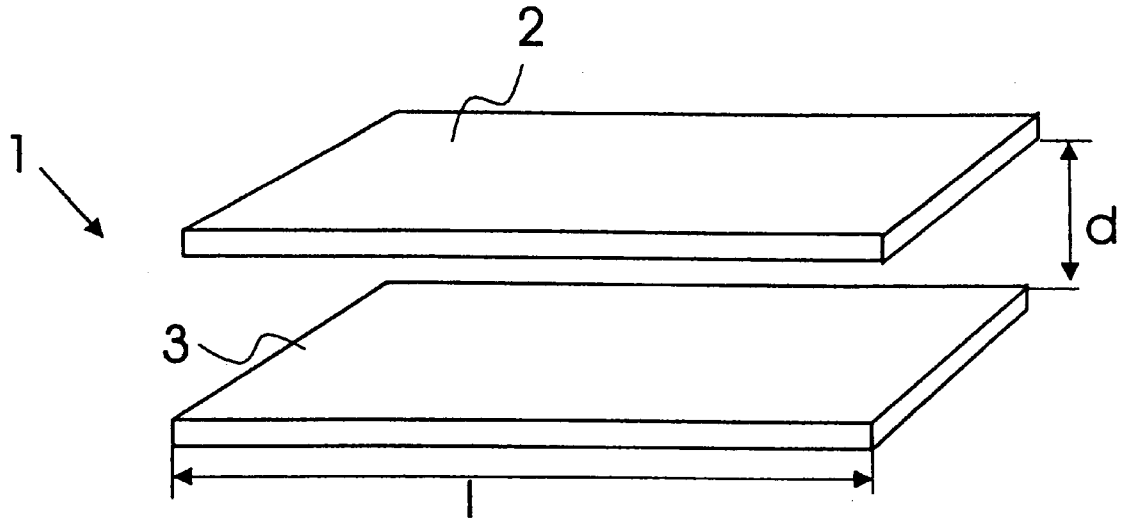
FIG. 1*a* is a perspective view of a security element of the prior art.

Referring now to FIG. 1*a* of the drawings, there is shown a perspective view of a security element 1 as known in the art. The security element 1 is comprised of a soft magnetic, magnetostrictive strip 2 of a length 1 and a premagnetization element 3 of a semihard or hard magnetic material spaced from the strip 2 at a distance d.

Figure 1B:
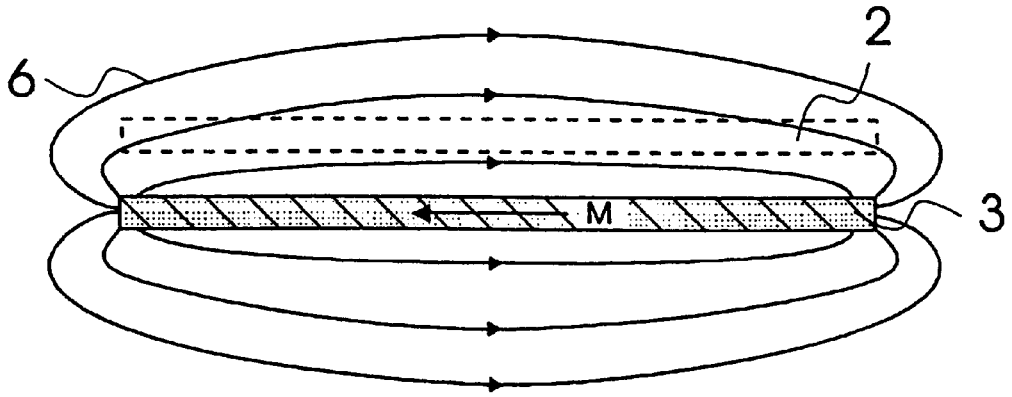
FIG. 1b (PRIOR ART)
FIG. 1*b* is a view of the stray field of the premagnetization element illustrated in FIG. 1*a;*

FIG. 1*b* illustrates the stray field 6 of the premagnetization element 3 which is dependent on the magnetization M. The strength of the stray field 6 influences the oscillatory response of the strip 2.

Figure 2A:
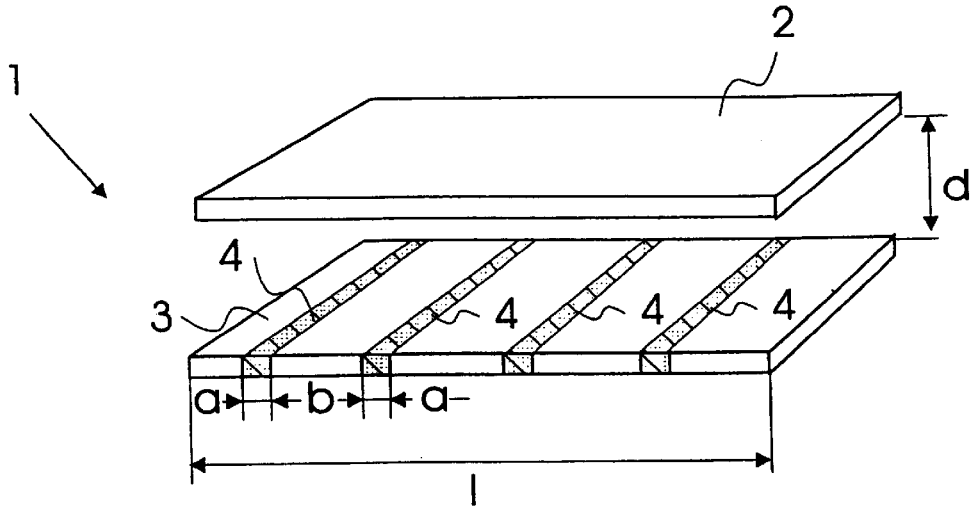
FIG. 2*a* is a perspective view of an embodiment of the security element of the present invention.
Figure 2B:
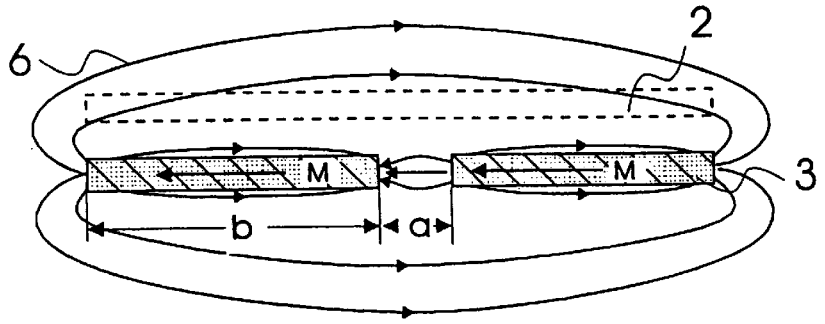
FIG. 2*b* is a view of the stray field of the premagnetization element illustrated in FIG. 2*b;*

FIG. 2*a* shows a perspective view of an embodiment of the security element 1 of the present invention. The premagnetization element 3 includes areas 4 of a width a spaced from each other by a distance b. These selected areas 4 are either areas 4 devoid of material (air gaps)—a corresponding illustration of the stray field 6 of the premagnetization element 3 shown in FIG. 2*b* is outlined in FIG. 2*b*—or heat-treated areas 4. Heat treatment may be performed using any one of the conventional methods, such as, laser beam irradiation, current supply, etc.

As becomes apparent from FIG. 2*b*, the selected areas 4 influence the magnetization M of the premagnetization element 3 and thus the coupling between the premagnetization element 3 and the magneto-elastic properties of the magnetostrictive strip 2. Any changes in the magnetization M due to variations of the width or the relative distance of the selected areas 4 of the premagnetization element 3 thus act directly upon the oscillatory response of the strip 2.

Figure 2C:
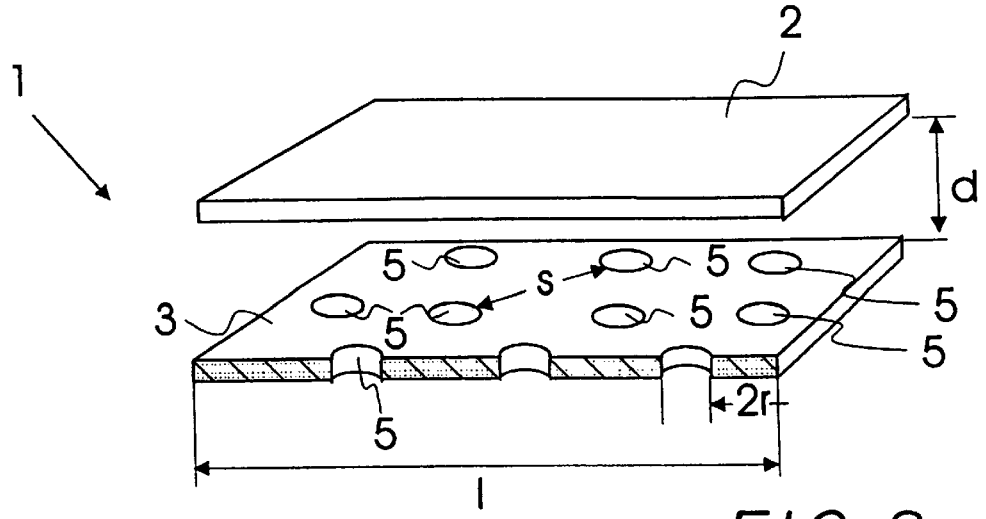
FIG. 2*c* is a perspective view of a further embodiment of the security element of the present invention.

FIG. 2*c* is a perspective view of a second embodiment of the security element 1 of the present invention. In this embodiment, the magnetization M of the premagnetization element 3 is varied by areas 5 of a circular configuration.

Figure 3A:
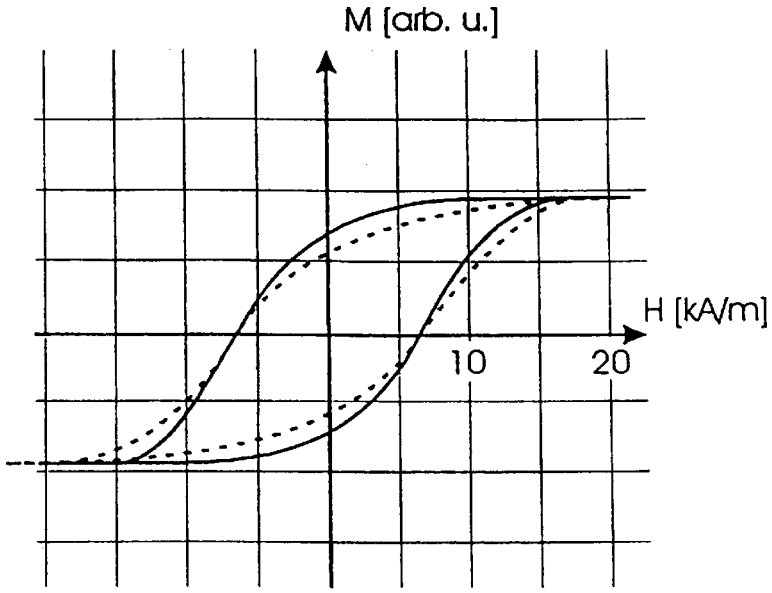
FIG. 3*a* is a view of the hysteresis curve of a security element of the present invention.
Figure 3B:
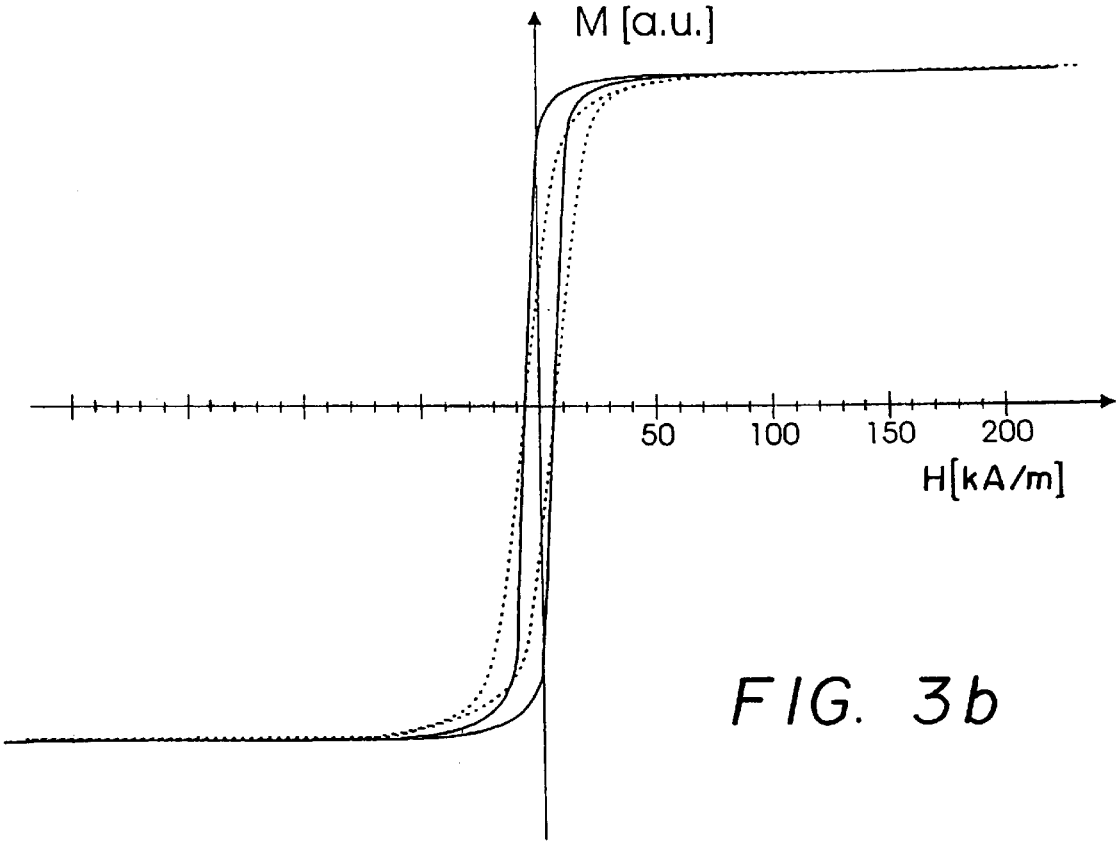
FIG. 3*b* is a view of the hysteresis curve of a security element of the present invention.

FIGS. 3*a* and 3*b* illustrate hysteresis curves (M-H diagrams) of premagnetization elements 3 constructed in accordance with the present invention (dashed lines) and of conventional premagnetization elements 3 not discussed within the scope of this invention. The remnant magnetization is changed considerably by the treatment of the premagnetization elements 3 in the selected areas 4.

Figure 4A:
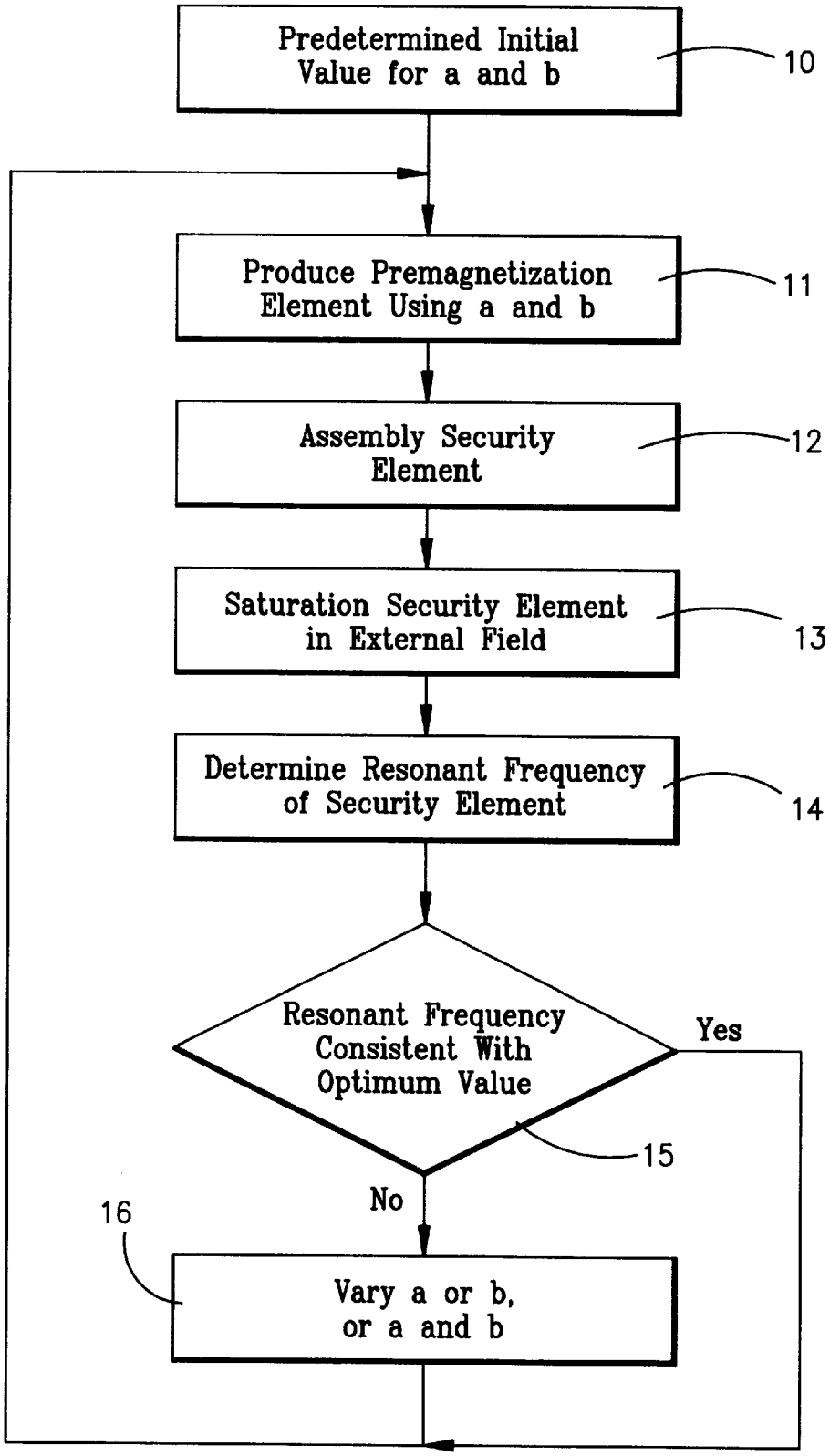
FIG. 4*a* is a flowchart for controlling an apparatus for implementing the method of the present invention.
Figure 4B:
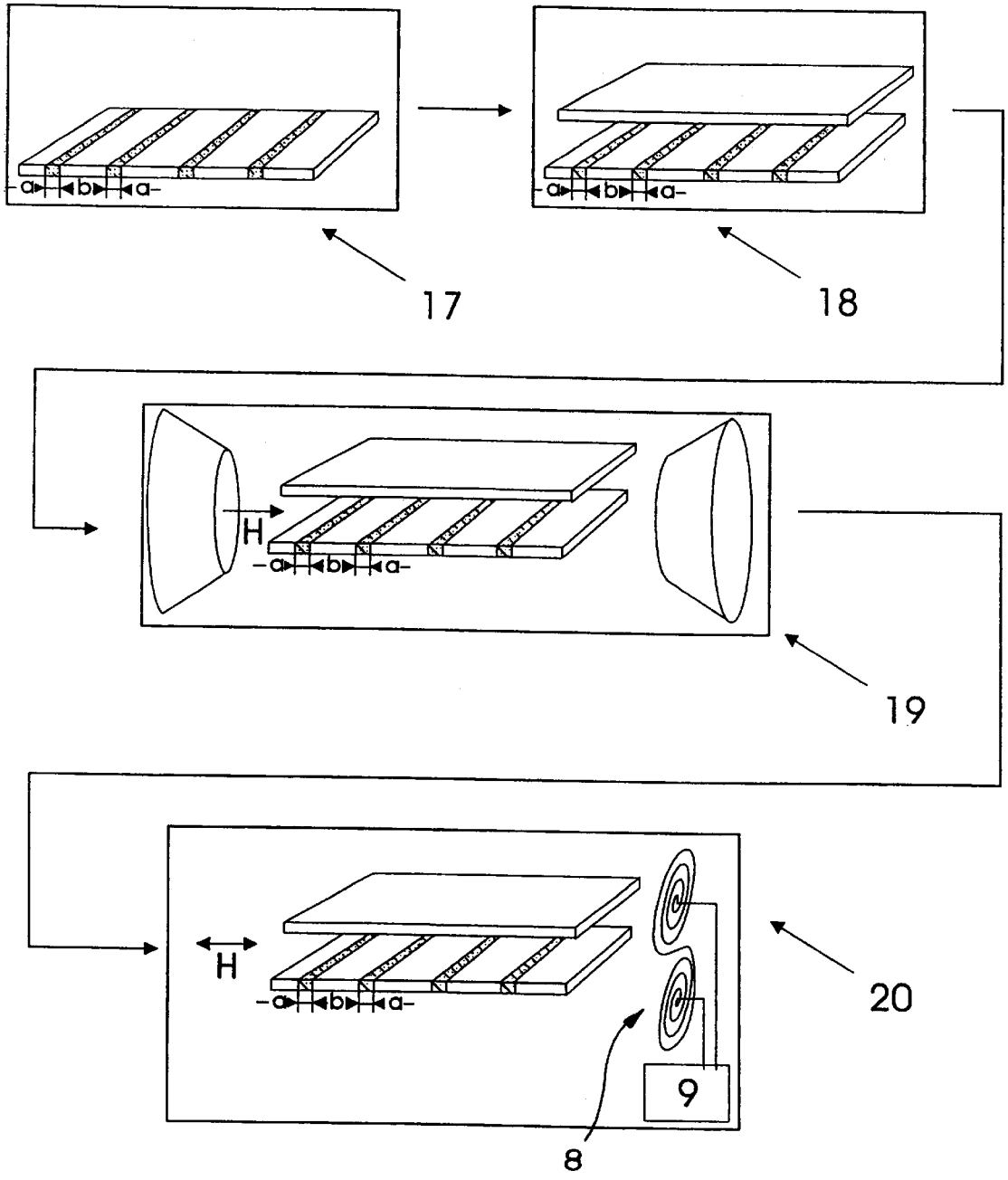
FIG. 4*b* is a schematic illustration of the individual process steps.

FIG. 4*a* shows a control program for implementing the method of the present invention; FIG. 4*b* outlines the individual stations served by the control program. At program step 10, the computing/control unit 9 receives the predetermined initial values for the width a of the selected areas 4 and for the relative distance b of the selected areas 4. At program step 11, the premagnetization element 3 is treated in accordance with the predetermined values a, b for the selected areas 4. In this connection, see also the representation 18 of FIG. 4*b*. At program step 12, the assembly of the security element 1 comprised of the premagnetization element 3 and the soft magnetic, magnetostrictive strip 2 is initiated. This process step is illustrated in FIG. 4*b* under reference numeral 19. Subsequently, in accordance with program step 13, the security element 1 is driven to saturation in an external field H. For this purpose—as can be seen in FIG. 4*b* at reference numeral 20—a transmitter device 7 is installed. This transmit device 7 may involve electromagnets or permanent magnets.

At program step 14, the resonant frequency of the security element 1 is then determined. The resonant frequency is measured by means of a receiver device 8—as illustrated in FIG. 4*b* at 21. The measured data is directed to the computing/control unit 9 for evaluation purposes.

At step 15 of the control program, the computing/control unit checks whether the resonant frequency measured is consistent with the optimum value. If the answer to this query is yes, the process continues with the predetermined values for a and b. If the resonant frequency is not consistent with the predetermined value, a and b or a or b are varied at step 16. Then the method of manufacturing the security elements 1 proceeds on the basis of the new initial values.

I claim:

1. A security element for electronic article surveillance in an electromagnetic surveillance system, comprising:

a soft magnetic, magnetostrictive strip; and a premagnetization element fabricated from one of a semi-hard and hard magnetic material associated with said soft magnetic, magnetostrictive strip, said premagnetization element being configured such that, by application of an essentially constant external field, it produces a stray field that optimizes the magneto-elastic properties of said soft magnetic, magnetostrictive strip, wherein said premagetization element is further configured such that it is driven into saturation by said constant external field, its remnant magnetization union saturation producing said stray field without said constant external field, and wherein said premagnetization element is dimensioned such that said stray field is smaller than the field necessary to achieve saturation of said soft magnetic, magnetostrictive strip.

2. The security element as defined in claim 1, wherein said soft magnetic, magnetostrictive strip and said premagnetization element are spaced apart by a given distance.

3. The security element as defined in claim 1, wherein said soft magnetic, magnetostrictive strip has an essentially linear magnetization curves.

4. The security element as defined in claim 1, wherein said premagnetization element includes areas devoid of material.

5. The security element as defined in claim 4, wherein said areas devoid of material comprise air gaps of a given width and spaced apart by a given distance.

6. The security element as defined in claim 4, wherein said areas devoid of material comprise holes of a given radius and spaced apart by a given distance.

7. The security element as defined in claim 1, wherein said premagnetization element includes areas of opposite magnetization which premagnetize said soft magnetic, magnetostrictive strip so as to deactivate it.

8. The security element as defined in claim 1, wherein said premagnetization element includes selected areas which are heat treated.

9. The security element as defined in claim 8, wherein said premagnetization element is heat treated in an oxidizing atmosphere.

10. The security element as defined in claim 8, wherein said selected areas are subject to mechanical stress to adjust a preferred direction transverse to the longitudinal direction of said premagnetization element.

11. The security element as defined in claim 8, wherein said selected areas are subject to said constant external field to adjust a preferred direction transverse to the longitudinal direction of said premagnetization element.

12. The security element as defined in claim 8, wherein said premagnetization element is heat treated in an oxidizing atmosphere.

13. The method of manufacturing a security element for electronic article surveillance in an electromagnetic surveillance system, in which the security element comprises a soft magnetic, magnetostrictive strip and a premagnetization element fabricated from one of a semi-hard and hard magnetic material, comprising the steps of;

providing the premagnetization element with one of air gays of a predetermined width, arranged at a given relative distance, heat-treated areas of a predetermined width, arranged at a given relative distance, and holes of a predetermined radius, arranged at a given relative distance;

magnetize the premagnetization element to saturation by a substantially constant external field; and checking the oscillatory response of the soft magnetic, magnetostrictive strip after removing the substantially constant external field and changing the physical properties of the premagnetization element if the oscillatory response of the security element is not consistent with a predetermined value.

14. The method as defined in claim 13, wherein the physical properties are changed such that the security element has a higher remnant magnetization than before the change.

15. The method as defined in claim 13, wherein the physical properties are changed such that the security element has a lower remnant magnetization than before the change.

16. The method as defined in claim 13, wherein the steps recited are executed continuously until the desired oscillatory response is obtained.

17. A security element for electronic article surveillance in an electromagnetic surveillance system, comprising:

a soft magnetic, magnetostrictive strip; and a premagnetization element fabricated from one of a semi-hard and hard magnetic material associated with said soft magnetic, magnetostrictive strip, said premagnetization element being configured to include one of air gaps of a predetermined width, arranged at a given relative distance, and heat-treated areas of a predetermined width, arranged at a given relative distance, and holes of a predetermined radius, arranged at a given relative distance, and being further configured such that, by application of an essentially constant external field, it produces a stray field that optimizes the magneto-elastic properties of said soft magnetic, magnetostrictive strip.

18. The security element as defied in claim 17, wherein said soft magnetic, magnetostrictive strip and said premagnetization element are spaced apart be a given distance.

* * * * *